US005369143A

United States Patent [19]

Kurimoto et al.

[11] Patent Number: 5,369,143

[45] Date of Patent: Nov. 29, 1994

[54] INORGANIC FIBER HAVING MODIFIED SURFACE AND ITS USE FOR REINFORCEMENT OF RESINS

[75] Inventors: Isao Kurimoto, Toyonaka; Naoki Inui, Yamatokoriyama; Kohji Yamatsuta; Hitoshi Murotani, both of Tsukuba; Hideo Nagasaki, Osaka; Shinichi Yachigo, Toyonaka, all of Japan

[73] Assignee: Sumitomo Chemical Company, Limited, Osaka, Japan

[21] Appl. No.: 113,769

[22] Filed: Aug. 31, 1993

Related U.S. Application Data

[63] Continuation of Ser. No. 442,699, Nov. 29, 1989, abandoned.

[30] Foreign Application Priority Data

Dec. 6, 1988 [JP] Japan ..... 63-308560

[51] Int. Cl.[5] ..... C08K 9/00

[52] U.S. Cl. ..... 523/215; 523/200; 523/216; 523/217; 524/236

[58] Field of Search ..... 523/200, 215, 216, 217; 524/236

[56] References Cited

U.S. PATENT DOCUMENTS 3,756,969 9/1973 Danielson ..... 260/3

3,806,489 4/1974 Rieux et al. ..... 260/38

FOREIGN PATENT DOCUMENTS 0253365 1/1988 European Pat. Off. .

*Primary Examiner*—Paul R. Michl

*Assistant Examiner*—U. K. Rajguru

*Attorney, Agent, or Firm*—Stevens, Davis, Miller & Mosher

[57] ABSTRACT

Inorganic fiber such as carbon fiber is modified by a surface treatment with a dinitrodiamine compound represented by the formula of wherein X is a divalent aliphatic, alicyclic or aromatic group which may contain halogen or oxygen in the group, $R^1$ is hydrogen, an aliphatic group, an alicyclic group or an aromatic group, with the proviso that two nitrogen atoms linking through X may further link through $R^1$ when both X and $R^1$ are the aliphatic groups, and $R^2$ and $R^3$ independently of one another are each hydrogen or an alkyl of 1 to 12 carbon atoms, with the proviso that $R^2$ and $R^3$ may conjointly form a ring. The inorganic fiber thus modified is useful for reinforcement of resins.

17 Claims, No Drawings

INORGANIC FIBER HAVING MODIFIED SURFACE AND ITS USE FOR REINFORCEMENT OF RESINS

This application is a continuation of application Ser. No. 07/442,699, filed Nov. 29, 1989 now abandoned.

The present invention relates to surface modification of inorganic fibers including carbon fiber and glass fiber, and to reinforcement of resins which uses the inorganic fibers having thus modified surfaces. In more particular, the invention relates to inorganic fibers having a modified surface which are useful for improving the bonding strength at the fiber/matrix resin interface (hereinafter referred to as f/m interface) in a composite of the resin and inorganic fiber such as carbon fiber and glass fiber thereby improving properties of the composite including mechanical properties and dynamic properties, to a method for producing the surface-modified fibers, and to reinforcement of resins by using the inorganic fibers thus modified.

Inorganic fibers including carbon fiber and glass fiber have such excellent features as light weight, high strength and high modulus of elasticity, and hence occupy important positions in the field of aircraft, transportation machinery, sporting goods etc. as reinforcements for composite materials.

When a resin is reinforced with an inorganic fiber to obtain a fiber reinforced plastic (hereinafter referred to as FRP), it is necessary to secure a high bonding strength at the f/m interface in order that the characteristic properties possessed by the fiber including high strength and high modulus of elasticity may be well reflected to the properties of the FRP. Further in recent years, the use of FRP as structural materials for aircrafts has greatly increased, and correspondingly the requirements for improving the static properties of FRP such as tensile strength, elastic modulus, compressive strength and interlaminar shear strength (hereinafter referred to as ILSS), and the dynamic properties of FRP such as fatigue strength and impact strength have been becoming increasingly more severe.

To fulfill such requirements, various sizing agent formulations and surface treating methods for inorganic fibers have been proposed and used.

As to the sizing agent formulation, there are known, for example, the use of polyvinyl alcohol as the sizing agent, the use of epoxy resin or polyimide resin as the sizing agent, and the use of epoxy resin emulsified with a suitable dispersing agent as the sizing agent. As to the surface treating method, there is known, for example, a method of treating the surface of inorganic fiber by using a silane coupling agent represented by the formula of $$R_1—Si(OR_2)_3$$

wherein $R_1$ is an organic group which has amino, epoxy, vinyl or the like and is reactive or compatible with plastic, and $R_2$ is methyl, ethyl or propyl.

Among the above-mentioned methods, the use of polyvinyl alcohol as the sizing agent has a problem in respect of the compatibility with thermosetting resins such as epoxy resin and polyimide resin usually employed as the matrix in FRP. The use of epoxy resin, polyimide resin or emulsified epoxy resin as the sizing agent has a problem of not being satisfactorily effective in improving the properties of FRP, although it shows some improvement in the handling of inorganic fiber.

The use of silane coupling agent as the surface treating agent is effective to some extent for a glass fiber having on its surface silanol groups capable of reacting with the silane coupling agent, however, it is not so satisfactorily effective for other inorganic fibers.

In view of such circumstances, the present inventors have made an extensive study to develop a surface treating agent for inorganic fibers which is capable of reaction-bonding by itself easily and firmly to various inorganic fibers including carbon fiber and glass fiber and is reactive or compatible with the matrix resin of a composite, and resultantly have found a surface treating agent having intended functions. The present invention has been accomplished on the basis of the above finding.

Thus, the present invention provides a composition of matter comprising inorganic fiber and a dinitrodiamine compound adhered onto the surface of the inorganic fiber, said dinitrodiamine compound being represented by the formula (I),

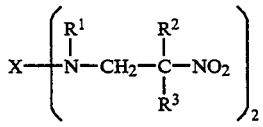

(I)

wherein X is a divalent aliphatic, alicyclic or aromatic group which may contain halogen or oxygen in the group, $R^1$ is hydrogen, an aliphatic group, an alicyclic group or an aromatic group, with the proviso that two nitrogen atoms linking through X may further link through $R^1$ when both X and $R^1$ are the aliphatic groups, and $R^2$ and $R^3$ independently of one another are each hydrogen or an alkyl of 1 to 12 carbon atoms, with the proviso that $R^2$ and $R^3$ may conjointly form a ring.

The present invention further provides a method for producing modified inorganic fiber by a surface treatment of inorganic fiber with the dinitrodiamine compound represented by the formula (I), a reinforcing material for a resin comprising the inorganic fiber thus treated, a method for reinforcing a resin using the inorganic fiber thus treated, and an FRP thus obtained.

It has been known from Publication No. 253,365 of European Patent Application that the dinitrodiamines represented by the formula (I) can improve dynamic properties of rubber. However, it has been found out for the first time by the present inventors that the dinitrodiamines are effective as surface treating agents for inorganic fiber.

Examples of the dinitrodiamines usable in the present invention include the following compounds, wherein —Z represents

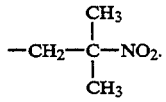

-continued
$Z-NH-(CH_2)_2-NH-Z$ (1)
$Z-NH-(CH_2)_3-NH-Z$ (2)
$Z-NH-(CH_2)_4-NH-Z$ (3)
$Z-NH-(CH_2)_6-NH-Z$ (4)
$Z-NH-(CH_2)_{10}-NH-Z$ (5)
$Z-NH-(CH_2)_{12}-NH-Z$ (6)
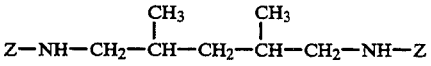
(7)
$NO_2-(CH_2)_2-NH-(CH_2)_2-NH-(CH_2)_2-NO_2$ (8)
$NO_2-(CH_2)_2-NH-(CH_2)_6-NH-(CH_2)_2-NO_2$ (9)
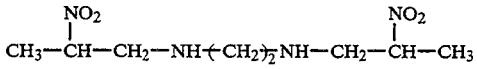
(10)
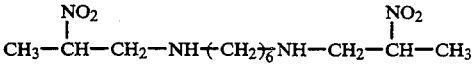
(11)
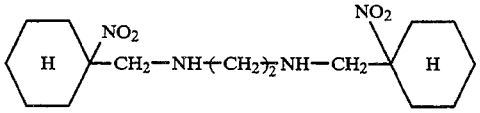
(12)
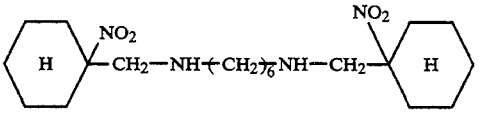
(13)
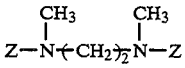
(14)
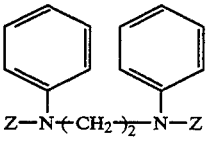
(15)
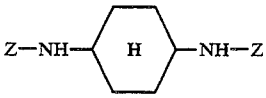
(16)
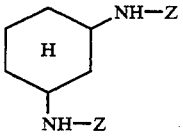
(17)
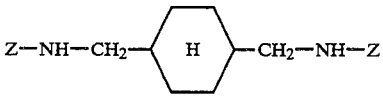
(18)
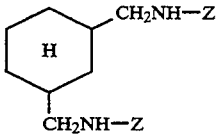
(19)
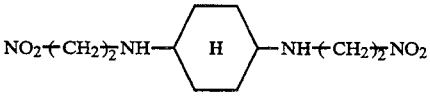
(20)
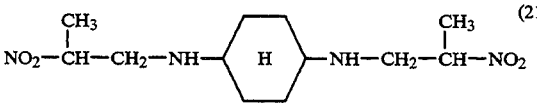
(21)
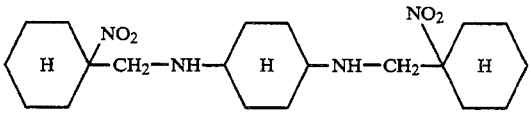
(22)
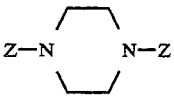
(23)
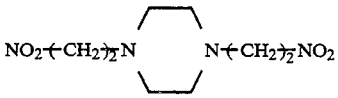
(24)
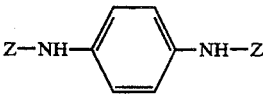
(25)
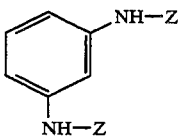
(26)
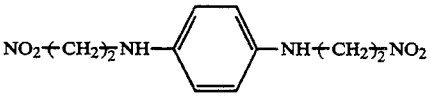
(27)
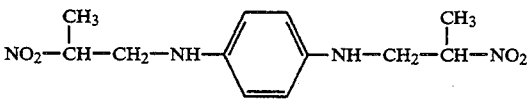
(28)
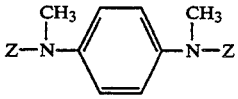
(29)
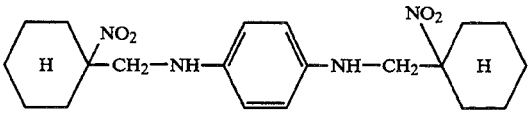
(30)

-continued
(31)
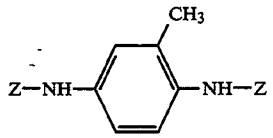
(32)
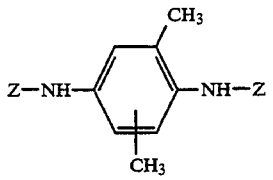
(33)
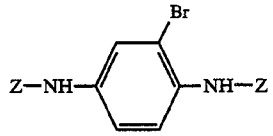
(34)
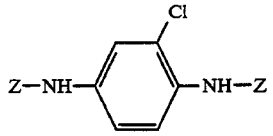
(35)
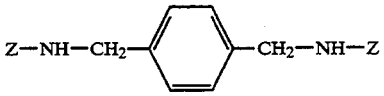
(36)
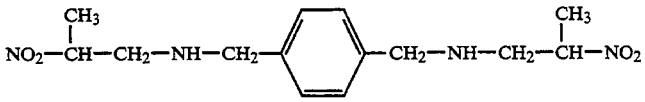
(37)
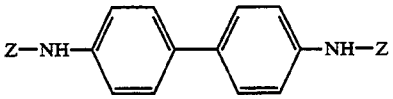
(38)
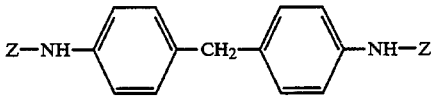
(39)
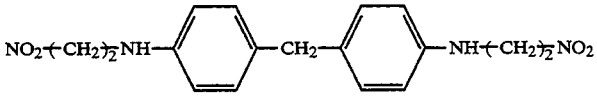
(40)
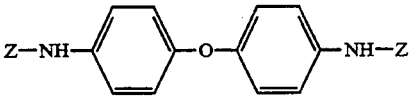
(41)
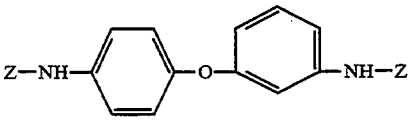
(42)
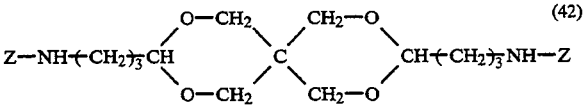
(43)
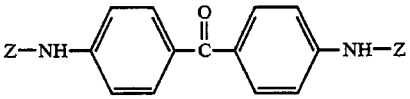
(44)
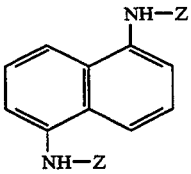
(45)
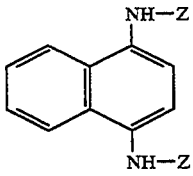
(46)
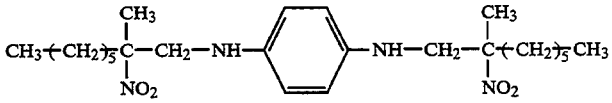
(47)
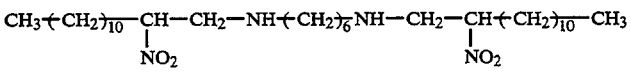
(48)
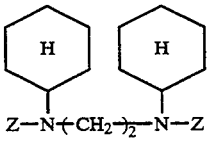
As exemplified above, the bridging group X in the formula (I) is a divalent aliphatic, alicyclic or aromatic group. X may contain halogen (e.g. fluorine, chlorine, bromine and iodine) in the group as in the 33rd and 34th examples, and alternatively may contain oxygen in the group as in the 40th to 43rd examples. The divalent aliphatic group denoted by X includes, for example, a straight chain or branched chain group, preferably an alkylene, of 1 to 18 carbon atoms and the like. The divalent alicyclic group denoted by X includes, for example, cyclohexylene,

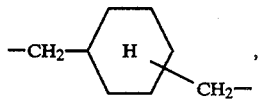

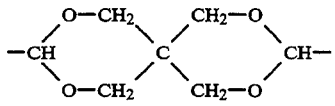

and the like. The divalent aromatic group denoted by X includes, for example, phenylene unsubstituted or substituted once or twice by lower alkyl (e.g. methyl) or halogen (e.g. chlorine or bromine),

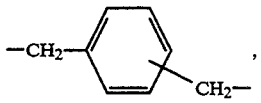

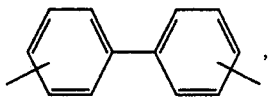

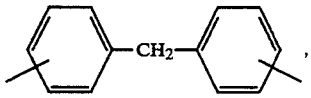

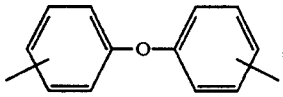

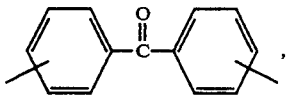

naphthylene and the like. Among them, preferred X is the aliphatic group. More preferably, X is the aliphatic group, particularly the alkylene, of 4 to 12 carbon atoms.

$R^1$ in the formula (I) is hydrogen, an aliphatic group, an alicyclic group or an aromatic group. The aliphatic group denoted by $R^1$ includes an alkyl of 1 to 6 carbon atoms and the like, the alicyclic group denoted by $R^1$ includes cyclopentyl, cyclohexyl and the like, and the aromatic group denoted by $R^1$ includes phenyl, tolyl and the like. Among them, preferred $R^1$ is hydrogen, the alkyl, cyclohexyl or phenyl, and more preferred is hydrogen. Alternatively, in case both X and $R^1$ are the aliphatic groups, two nitrogen atoms linking through X can further link through $R^1$ to form a ring composed of X, $R^1$ and two nitrogen atoms as in the above 23rd and 24th examples. Such rings include, for example, piperazine ring and the like.

$R^2$ and $R^3$ in the formula (I) can be the same or different from each other, and are hydrogen or an alkyl of 1 to 12 carbon atoms. Preferably, at least one of $R^2$ and $R^3$ is an alkyl of 1 to 12 carbon atoms, and more preferably they are both methyl. Alternatively, $R^2$ and $R^3$ can conjointly link to form, together with carbon atoms bonding to them, a ring such as a six-membered ring, as in the above 12th, 13th, 22nd and 30th examples.

When such dinitrodiamine compounds are used as the surface treating agent for inorganic fiber, they may be used each alone or as a mixture of two or more thereof.

One of the most important properties required for surface treating agents of inorganic fiber is that they are capable of reaction-bonding by themselves easily and firmly to the surface of the inorganic fiber and are reactive or compatible with the matrix resin to be reinforced. The dinitrodiamines represented by the above formula (I) readily generate a radically active species by heating as a characteristic property of a nitro compound, and the active species can react with the inorganic fiber or with the resin through a radical reaction. Further, the dinitrodiamines can, as a characteristic property of an amino compound, easily react and bond with acidic functional groups on the inorganic fiber surface, e.g. carboxylic acid groups and phenolic hydroxyl groups on the carbon fiber surface and silanol groups on the glass fiber surface. When epoxy resin is used as the matrix resin, the amino group of the dinitrodiamine compound can readily react with the epoxy group of the resin to form a strong bond. Further, the bridging group X in the dinitrodiamine compound represented by the formula (I) is an aliphatic, alicyclic or aromatic group, and such a dinitrodiamine compound has a sufficient compatibility with resins used as the matrix.

Examples of inorganic fibers usable in the present invention include carbon fiber, graphite fiber, glass fiber, silicon carbide fiber, alumina fiber, titania fiber and boron nitride fiber. Particularly preferred among them is carbon fiber. These inorganic fibers may be used in the form of continuous tow, woven cloth, short fiber, whisker, etc.

A method commonly used for the surface treatment of inorganic fibers using the dinitrodiamine compound represented by the above formula (I) is to treat the inorganic fiber with a solution prepared by dissolving one or more of the dinitrodiamine compounds in a solvent. In this case, a solution having a concentration of the dinitrodiamine compound of about 0.01–10% by weight is preferably used. Examples of solvents which may be used include halogenated hydrocarbons such as carbon tetrachloride and methylene chloride, aliphatic ketones such as acetone and methyl ethyl ketone, aromatic hydrocarbons such as toluene, and ethers such as tetrahydrofuran and diethyl ether. Aliphatic hydrocarbons such as hexane and heptane are not so preferred as the solvent to be used in the present invention in respect of the solubility of the dinitrodiamine compound. Water is also not so preferred as the solvent to be used in the present invention because it causes hydrolysis of the dinitrodiamine compound.

The method of treating inorganic fiber with a solution containing the dinitrodiamine compound mentioned above will be further described in detail below. A preferred method is to use the solution as an impregnation bath and immerse a fiber strand in the bath for about 1–60 seconds, for example. Other methods which may be used include, for example, spraying a solution containing the dinitrodiamine compound to the fiber strand, or contacting a solution containing the dinitrodiamine compound with the fiber by using a kiss-roll. What is essential is to make the inorganic fiber contact with the dinitrodiamine compound, and the dinitrodiamine compound is thereby easily adhered to the surface of the inorganic fiber. The amount of the dinitrodiamine compound to be adhered to inorganic fiber is preferably about 0.01–10% by weight, more preferably about 0.1–1% by weight.

The inorganic fiber thus treated is, if necessary, removed of excess of the treating agent and then dried by heating to obtain a fiber suitable for reinforcement of resins. The temperature of the drying by heating has an important influence on the reaction between the inorganic fiber and the dinitrodiamine compound. Generally, it is preferably not lower than 80° C., more preferably not lower than 120° C., and is preferably not higher than 300° C.

In the surface treatment of inorganic fiber, a conventional sizing treatment may be applied in combination with the surface treatment of the present invention. Examples of sizing agents which may be used include a variety of vinyl polymers and further various epoxy resins such as bisphenol A diglycidyl ether-type epoxy resin, novolak-type epoxy resin and diaminodiphenylmethane-type epoxy resin, and also polyimide resins.

Among these sizing agents, the vinyl polymers are those obtained by polymerizing one or more ethylenically unsaturated compounds. Examples of monomers which can be the constituent of such vinyl polymers include monoalkyl esters of various unsaturated carboxylic acids, e.g., alkyl methacrylates such as methyl methacrylate, ethyl methacrylate, butyl methacrylate and lauryl methacrylate, alkyl acrylates such as methyl acrylate, ethyl acrylate, butyl acrylate and 2-ethylhexyl acrylate, and monomethyl, monoethyl, monobutyl or the like esters of itaconic acid, maleic acid, fumaric acid, vinylacetic acid, α-ethylacrylic acid, etc. Further examples of the monomers are styrenes such as styrene and α-methylstyrene, aliphatic acid vinyl esters such as vinyl acetate and vinyl propionate, unsaturated hydrocarbons such as butadiene and isoprene, halogenated unsaturated hydrocarbons such as vinyl chloride and chloroprene, unsaturated alcohols such as vinyl alcohol, unsaturated nitrile compounds such as acrylonitrile and methacrylonitrile, unsaturated acid anhydrides such as maleic anhydride and itaconic anhydride, 2-hydroxyethyl methacrylate, 3-hydroxyproyl methacrylate, 2-chloro-3-hydroxypropyl methacrylate, phosphoric acid mono(hydroxypropyl methacrylate) ester, acrylamide, methacrylamide, N-methylolacrylamide, N-methoxymethylacrylamide, N-butoxymethylacrylamide, glycidyl methacrylate and glycidyl acrylate. It is to be understood here that the monomers mentioned above include, besides those which can be a starting material for polymerization by themselves, those monomers which, though by themselves are difficult to polymerize, can be the constituent of polymer by other suitable means (for example vinyl alcohol, which is the constituent of polyvinyl alcohol).

When sizing is conducted, it may be applied simultaneously with the surface treatment by dissolving the sizing agent as described above together with the dinitrodiamine compound represented by the formula (I) in an organic solvent such as carbon tetrachloride, methyl ethyl ketone and tetrahydrofuran, or it may be applied by using the sizing agent as described above after the surface treatment according to the present invention has been applied..

The inorganic fiber surface-treated according to the present invention is useful as a reinforcing fiber for epoxy resin, other thermosetting resins such as unsaturated polyester resin and polyimide resin, and thermoplastic resins such as nylon, polyethersulfone, polyetheretherketone, polycarbonate, ABS resin, polypropylene, polystyrene, polyethylene terephthalate, polyacetal, fluorocarbon resin and methacrylate resin. An FRP with excellent properties can be obtained by incorporating the inorganic fiber to the resin.

The method to be used for incorporating the inorganic fiber into the resin is not particularly limited in the present invention, and a variety of methods for preparation of FRP known to the art may be used. One example of the methods is to impregnate in a molten liquid resin the surface-treated inorganic fiber as described above. The fiber-containing resin thus obtained is, for example, used as prepreg or in filament winding to give a product of suitable form, e.g. a plate, which is then heated under pressure to obtain the FRP. The heating under pressure is performed by using, for example, such means as an autoclave or hot press and usually at constant pressure and constant temperature.

The volumetric content of fiber (Vf) in the FRP thus obtained can be adjusted as desired by proper selection of preparation conditions. In general the Vf is preferably about 50–70%, more preferably about 60%.

When the inorganic fiber is continuous as in continuous tow, a continuous process may also be effectively adopted, which comprises immersing such continuous fiber in a solution of the dinirtrodiamine compound represented by the formula (I), drying the fiber, then impregnating the surface-treated inorganic fiber in a molten liquid resin, and heating under pressure the resulting fiber-containing resin.

The surface-modified inorganic fiber according to the present invention, when incorporated into resin, is effective in improving the bonding strength at the f/m interface of the resulting composite and in improving the mechanical, dynamic and other properties of the composite. Accordingly, resins reinforced with such inorganic fiber are excellent in mechanical properties and dynamic properties and, by virtue of such features, can be used as the structural material for aircraft, transportation machinery, sporting goods, etc.

The present invention will be explained in more detail with reference to Examples covering the surface treatment of inorganic fiber using the dinitrodiamine compound represented by the formula (I), the preparation of FRP using the inorganic fiber, and the properties of the FRP obtained. However, the present invention is in no way limited by these Examples.

EXAMPLE 1

A tow (composed of 12,000 single yarns of 7.4 μm diameter) of carbon fiber (MAGNAMITE AS-4, registered trade name, mfd. by Hercules Inc.; tensile strength: 390 kg/mm$^2$, tensile modulus of elasticity: 24 t/mm$^2$) was treated with a 5% by weight toluene solution of N,N'-bis(2-methyl-2-nitropropyl)-1,6-diaminohexane (hereinafter referred to as compound A). The treatment was conducted by passing the carbon fiber tow continuously through the toluene solution of the compound A at a velocity of 3.6 m/min thereby to make the treating liquid permeate thoroughly between the single yarns, then removing excess of the treating liquid by means of a squeezing roller, and drying the tow under vacuum at 150° C. for 2 hours. The amount of the compound A adhered was 0.8% by weight based on the carbon fiber tow.

EXAMPLE 2

Treatments were conducted in the same manner as in Example 1 except for using the following compounds B to D respectively in place of the compound A, to obtain respective surface-treated carbon fibers.

B: N,N'-Bis(2-methyl-2-nitropropyl)-1,4-diaminobenzene

C: N,N'-Bis(2-methyl-2-nitropropyl)-1,4-diaminocyclohexane

D: N,N'-Bis(2-nitropropyl)-1,6-diaminohexane

EXAMPLE 3

The carbon fiber tow obtained in Example 1 was paralleled, and the resulting paralleled fibers were impregnated with the following resin composition to obtain a prepreg sheet having a thickness of 125 μm and a resin content of 35% by weight. The composition of the resin used was as follows.

| | |
|---|---|
| "Sumiepoxy ELM 434" (registered trade name of epoxy resin mfd. by Sumitomo Chemical Co., Ltd.; component: polyglycidyl ether of diaminodiphenylmethane) | 60 parts by weight |
| "Sumiepoxy ESCN 220 HH" (registered trade name of epoxy resin mfd. by Sumitomo Chemical Co., Ltd.; component: polyglycidyl ether of cresol novolak) | 15.5 parts by weight |
| Diaminodiphenyl sulfone | 20 parts by weight |
| Dicyandiamide | 2.3 parts by weight |
| N,N-Benzyldimethylamine | 0.2 part by weight |

The prepreg sheet obtained above was cut to a size of 100 mm width and 150 mm length. Seventeen (17) cut sheets were laminated in one direction and then finished in an autoclave under nitrogen pressure of 6 kg/cm$^2$ at 160° C. for 1 hour. Resultantly a plate-form article having a thickness of 2.0 mm and a volumetric content of fiber (Vf) of 60.3% was obtained.

The formed article was fabricated into test pieces having fiber-directional length and 6 mm width, and their 0° bending strength and ILSS were determined. The results obtained are shown in Table 1.

EXAMPLES 4 TO 6

In the same manner as in Example 3 except for using the respective carbon fiber tow obtained in Example 2 in place of the carbon fiber tow obtained in Example 1, plate-form articles were prepared, fabricated into test pieces of the same shape, and their 0° bending strength and ILSS were determined. The results obtained are shown in Table 1.

COMPARATIVE EXAMPLE 1

In the same manner as in Example 3 except for using the carbon fiber tow employed in Example 1 as it was untreated, a plate-form article was prepared, fabricated into test pieces of the same shape, and their 0° bending strength and ILSS were determined. The results obtained are shown in Table 1.

TABLE 1

| | 0° Bending strength (kg/mm$^2$) | ILSS (kg/mm$^2$) |
|---|---|---|
| Example 3 (Compound A was used) | 231 | 15 |
| Example 4 (Compound B was used) | 228 | 14.5 |
| Example 5 (Compound C was used) | 225 | 14 |
| Example 6 (Compound D was used) | 226 | 14 |
| Comparative Example 1 (Untreated) | 220 | 12 |

EXAMPLE 7

An aluminum plate of 200 mm square and 5 mm thickness was attached as a mandrel to a filament winding machine. Then, the same carbon fiber as used in Example 1 was immersed in a 3% by weight toluene solution of the compound A, passed through a drying zone, then passed through a molten liquid matrix resin shown below, and wound round the mandrel. The molten liquid matrix resin used had the following composition:

| | |
|---|---|
| Sumiepoxy ELA 128 (registered trade name, mfd. by Sumitomo Chemical Co., Ltd.) | 100 parts by weight |
| Epoxy resin curing agent HN5500 (mfd. by Hitachi Chemical Co., Ltd.) | 85 parts by weight |
| Curing accelerator Sumicure D (registered trade name, mfd. by Sumitomo Chemical Co., Ltd.) | 1 part by weight |

and had a viscosity of 1500 cp at the time of winding (20° C.).

The drying conditions at the drying zone were 160° C.×1 minute. The amount of the compound A adhered to the carbon fiber was 0.6% by weight. The winding velocity was 1 m/minute.

The plate-form product thus obtained was cured in a hot press at a pressure of 10 kg/cm$^2$ and a temperature of 150° C. for 2 hours. Then the fiber-containing resin was detached from the aluminum plate to obtain a unidirectionally fiber-reinforced resin plate of 2 mm in thickness. The volumetric content of fiber (Vf) in the resin plate was 60.5%.

Fiber-directionally long test pieces of 6 mm width were cut out from the fiber reinforced resin plate and their 0° bending strength and ILSS were determined. The results obtained are shown in Table 2.

COMPARATIVE EXAMPLE 2

In the same manner as in Example 7 except that the carbon fiber was not immersed in the toluene solution of the compound A, a unidirectionally fiber-reinforced resin plate was prepared, test pieces of the same shape was cut out therefrom, and their 0° bending strength and ILSS were determined. The results obtained are shown in Table 2.

TABLE 2

| | 0° Bending strength (kg/mm$^2$) | ILSS (kg/mm$^2$) |
|---|---|---|
| Example 7 (Compound A was used) | 203 | 8.4 |
| Comparative Example 2 | 180 | 6.3 |

TABLE 2-continued

| | 0° Bending strength (kg/mm²) | ILSS (kg/mm²) |
|---|---|---|
| (Untreated) | | |

What is claimed is:

1. A method for reinforcing an epoxy resin, which comprises incorporating into the epoxy resin a composition of matter comprising inorganic fiber and a dinitrodiamine compound adhered onto the surface of the inorganic fiber, said dinitrodiamine compound being represented by the formula of

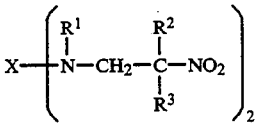

wherein X is a divalent aliphatic, alicyclic or aromatic group which may contain halogen or oxygen in the group, $R^1$ is hydrogen, an aliphatic group, an alicyclic group or an aromatic group, with the proviso that two nitrogen atoms linking through X may further link through $R^1$ when both X and $R^1$ are the aliphatic groups, and $R^2$ and $R^3$ independently of one another are each hydrogen or an alkyl of 1 to 12 carbon atoms, with the proviso that $R^2$ and $R^3$ may conjointly form a ring; thereby improving bonding strength at the fiber/matrix resin interface of the resulting composite.

2. A fiber reinforced plastic comprising an epoxy resin and a composition of matter comprising inorganic fiber and a dinitrodiamine compound adhered onto the surface of the inorganic fiber, said dinitrodiamine compound being represented by the formula of

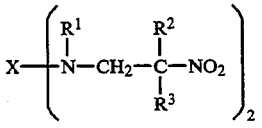

wherein X is a divalent aliphatic, alicyclic or aromatic group which may contain halogen or oxygen in the group, $R^1$ is hydrogen, an aliphatic group, an alicyclic group or an aromatic group, with the proviso that two nitrogen atoms linking through X may further link through $R^1$ when both X and $R^1$ are the aliphatic groups, and $R^2$ and $R^3$ independently of one another are each hydrogen or an alkyl of 1 to 12 carbon atoms, with the proviso that $R^2$ and $R^3$ may conjointly form a ring whereby the reinforced plastic is improved in bonding strength at the fiber/matrix resin interface.

3. The fiber reinforced plastic according to claim 2, wherein the volumetric content of the fiber is about 50 to about 70% based on the volume of the fiber reinforced plastic.

4. The fiber reinforced plastic according to claim 2, wherein the inorganic fiber is carbon fiber.

5. The fiber reinforced plastic according to claim 2, wherein the inorganic fiber is in a form of continuous tow, woven cloth, short fiber or whisker.

6. The fiber reinforced plastic according to claim 2, wherein the dinitrodiamine compound is adhered in an amount of about 0.01 to about 10% by weight based on the weight of the inorganic fiber.

7. The fiber reinforced plastic according to claim 2, wherein the amount of the dinitrodiamine compound is about 0.1 to about 1% by weight based on the weight of the inorganic fiber.

8. The fiber reinforced plastic according to claim 2, wherein the dinitrodiamine compound is one where X is a divalent aliphatic group of 1 to 18 carbon atoms.

9. The fiber reinforced plastic according to claim 2, wherein X is a divalent aliphatic group of 4 to 12 carbon atoms.

10. The fiber reinforced plastic according to claim 2, wherein the dinitrodiamine compound is one where X is cyclohexylene,

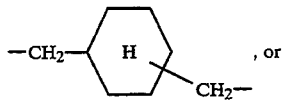

, or

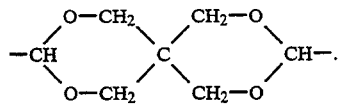

.

11. The fiber reinforced plastic according to claim 2, wherein the dinitrodiamine compound is one where X is phenylene unsubstituted or substituted,

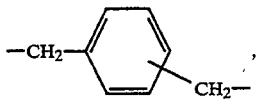

,

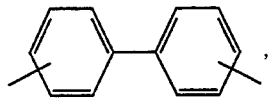

,

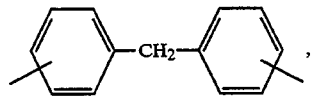

,

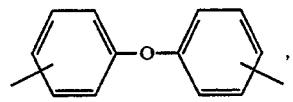

,

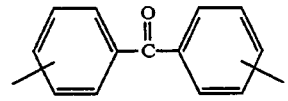

or naphthylene.

12. The fiber reinforced plastic according to claim 2, wherein the dinitrodiamine compound is one where $R^1$ is hydrogen, an alkyl of 1 to 6 carbon atoms, cyclohexyl or phenyl.

13. The fiber reinforced plastic according to claim 2, wherein the dinitrodiamine compound is one where X, $R^1$ and two nitrogen atoms conjointly form a ring of

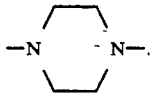

14. The fiber reinforced plastic according to claim 2, wherein the dinitrodiamine compound is one where at least one of $R^2$ and $R^3$ is an alkyl of 1 to 12 carbon atoms.

15. The fiber reinforced plastic according to claim 2, wherein $R^2$ and $R^3$ are both methyl.

16. The fiber reinforced plastic according to claim 2, wherein the dinitrodiamine compound is one where $R^2$ and $R^3$ together with a carbon atom bonding thereto conjointly form a six-membered ring.

17. The fiber reinforced plastic according to claim 2, wherein the dinitrodiamine compound is one where X is an alkylene of 4 to 12 carbon atoms, $R^1$ is hydrogen, and $R^2$ and $R^3$ are both methyl.

* * * * *